US009849687B2

(12) United States Patent
Katou et al.

(10) Patent No.: US 9,849,687 B2
(45) Date of Patent: Dec. 26, 2017

(54) INKJET RECORDING DEVICE

(71) Applicant: Hitachi Industrial Equipment Systems Co., Ltd., Chiyoda-ku, Tokyo (JP)

(72) Inventors: Manabu Katou, Tokyo (JP); Nobuhiro Harada, Tokyo (JP); Masahiko Sakuraba, Toko (JP); Takehiko Matsushita, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 15/300,528

(22) PCT Filed: Dec. 8, 2014

(86) PCT No.: PCT/JP2014/082361
§ 371 (c)(1),
(2) Date: Sep. 29, 2016

(87) PCT Pub. No.: WO2015/151340
PCT Pub. Date: Oct. 8, 2015

(65) Prior Publication Data

US 2017/0120615 A1 May 4, 2017

(30) Foreign Application Priority Data

Mar. 31, 2014 (JP) ..... 2014-070864

(51) Int. Cl.
*B41J 2/175* (2006.01)
*B41J 29/38* (2006.01)

(52) U.S. Cl.
CPC ..... *B41J 2/17566* (2013.01); *B41J 29/38* (2013.01)

(58) Field of Classification Search
CPC B41J 2/17566; B41J 2/17569; B41J 2/17573; B41J 2/17579; B41J 2/17583; B41J 2/17586; B41J 2/17589; B41J 29/38
(Continued)

(56) References Cited

U.S. PATENT DOCUMENTS 5,918,267 A 6/1999 Evans et al.
2005/0068350 A1 3/2005 Okawa
(Continued)

FOREIGN PATENT DOCUMENTS

CN 101048286 A 10/2007
CN 101434150 A 5/2009
(Continued)

OTHER PUBLICATIONS

International Search Report (PCT/ISA/210) issued in PCT Application No. PCT/JP2014/082361 dated Mar. 24, 2015 with English translation (3 pages).
(Continued)

*Primary Examiner* — Huan Tran
*Assistant Examiner* — Alexander D Shenderov
(74) *Attorney, Agent, or Firm* — Crowell & Moring LLP

(57) ABSTRACT

This invention is intended to provide a ink-jet printing device which can detect leak of ink or solvent without the exclusive sensor for leak detection and without increasing cost. An ink jet printing device for printing letter by ejecting ink, comprising, a liquid container for containing ink or solvent, a surface level sensor for detecting surface level arranged on the liquid container, a control unit and a display unit, wherein the display unit displays indication in the case where the surface level change time detected by the control unit using the surface level sensor is larger than the settled surface level change time in settled printing condition is provided for solving the problem.

12 Claims, 7 Drawing Sheets

(58) Field of Classification Search
USPC ..... 347/7
See application file for complete search history.

(56) References Cited

U.S. PATENT DOCUMENTS

| | | | | |
|---|---|---|---|---|
| 2007/0008371 | A1 | 1/2007 | Ishihara | |
| 2007/0097160 | A1* | 5/2007 | Lyman | B41J 2/17566 347/5 |
| 2009/0015622 | A1 | 1/2009 | Karaki et al. | |
| 2009/0122122 | A1 | 5/2009 | Kubo et al. | |

FOREIGN PATENT DOCUMENTS

| | | | |
|---|---|---|---|
| CN | 102407661 | A | 4/2012 |
| DE | 101 17 885 | A1 | 10/2002 |
| JP | 2004-181785 | A | 7/2004 |
| JP | 2009-51110 | A | 3/2009 |

OTHER PUBLICATIONS

Japanese-language Written Opinion (PCT/ISA/237) issued in PCT Application No. PCT/JP2014/082361 dated Mar. 24, 2015 (3 pages).
"KGKJET CCS3000 Manual (Operation Series/ Maintenance Series)", Kishu Giken Kogyo Co., Ltd., p. 213 with English translation (4 pages).
Chinese-language Office Action issued in counterpart Chinese Application No. 201480077519.8 dated Mar. 3, 2017 with unverified English translation (fifteen (15) pages).
Extended European Search Report issued in counterpart European Application No. 14887876.2 dated Oct. 18, 2017 (10 pages).

* cited by examiner

INKJET RECORDING DEVICE

TECHNICAL FIELD OF THE INVENTION

This invention relates to the ink-jet printing device with the leak detective function of ink or solvent.

BACKGROUND ART

The way that the electric charge control type ink-jet printing device works is to eject pressured ink from a nozzle, to give an electric charge from a charged electrode to these ink particles by applying the charged voltage which is to become a letter signal, to deflect the charged particles vertically in inclination electric fields, and to form the letter to a printing object moving approximately perpendicularly to the direction that the ink particles deflect, and the electric charge control type ink-jet printing device is put to practical use by uses such as the printing in the expiration date to foods. It is preferable to detect leak of ink or solvent of such kind of the ink-jet printing device, because it is difficult to completely prevent leak from the course (tube and joint) and the containers that occur for some causes.

A method mentioned in the non-patent document 1 is generally and conventionally used to detect leak; in order to detect leak, the device comprising a exclusive sensor for the leak detection in the floor region of the device, and detecting ink or solvent which collected into floor region by the sensor.

CONVENTIONAL ART DOCUMENTS

Non-Patent Documents

Non-patent document 1: published by Kishu Giken Kogyo Co., Ltd. KGKJET CCS3000 instruction manual (213 pages of operation, maintenance)

SUMMERY OF THE INVENTION

Problem to Solve by the Invention

There are faults such as increase of the cost, structural limitation in the sensor placement, the man-hour increase in the production, because the technique mentioned by the non-patent document 1 needed an exclusive sensor.

Therefore this invention is intended to provide a ink-jet printing device which can detect leak of ink or solvent without the exclusive sensor for leak detection and without increasing cost.

Means for Solving Problem

The constitutions mentioned in claims are adopted to solve the problem mentioned above.

This invention includes plural means to solve the problem mentioned above, and an example is; an ink jet printing device for printing letter by ejecting ink, comprising, a liquid container for containing ink or solvent, a surface level sensor for detecting surface level arranged on the liquid container, a control unit and a display unit, wherein the display unit displays indication in the case where the surface level change time detected by the control unit using the surface level sensor is larger than the settled surface level change time in settled printing condition is provided for solving the problem.

Effect of the Invention

According to this invention, an ink-jet printing device detecting leak of ink or solvent without increasing cost can be provided.

MODES FOR CARRYING OUT THE INVENTION

The leak detection is realized by continuously watching time change of the surface level in the ink-jet printing device comprising containers containing ink and solvent, a container for mixing them or viscosity adjustments of them as needed, and means for detecting surface of these containers.

Figure 1:
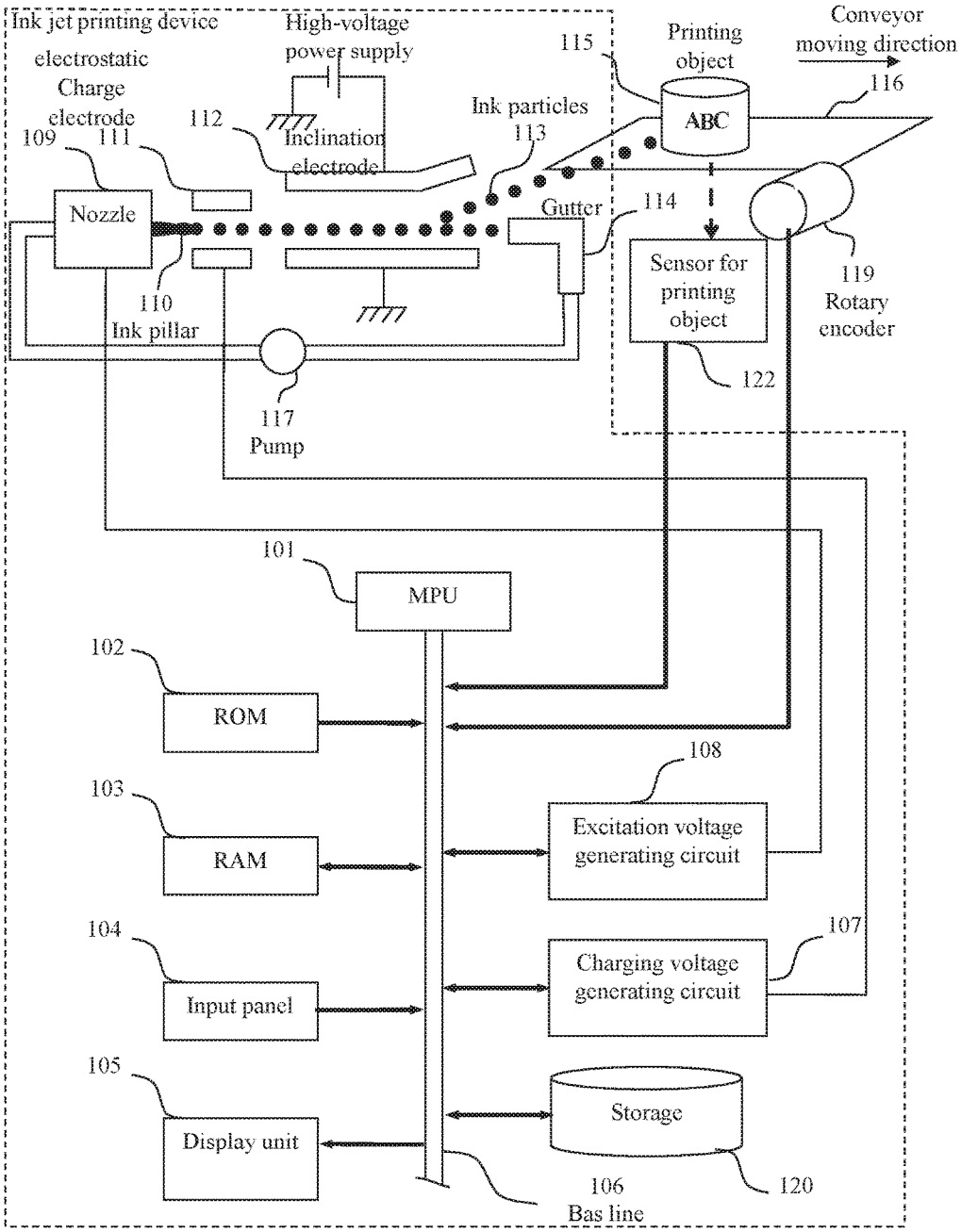
FIG. 1 the illustration of the constitution of the ink-jet printing device.

An example of the embodiments of this invention will be described using figures. FIG. 1 is a block diagram indicating the representative constitution of the ink-jet printing device in this embodiment.

The ink-jet printing device has a MPU (micro processing unit) 101 for controlling whole IJP 101, a ROM or flash memory 102 for storing program and data that is necessary for MPU to work, and a RAM 103 for temporarily storing data which is necessary during program practice.

The ink-jet printing device is accessible with an auxiliary memory 120 for storing program or printing data and a representative thing of the auxiliary memory includes USB memory. The ink-jet printing device further comprises an input panel 104 for inputting printing contents or setting value, a display unit 105 for displaying such as input data, printing contents, and a bus line 106 for transmitting address signal and control signal of the MPU.

The ink-jet printing device further comprises an excitation voltage generating circuit 108 connected to a nozzle 109 for generating the voltage in order to particulate the ink, and a charging voltage generating circuit 107 for generating voltage to the ink particles corresponding to letter signal. In addition, a rotary encoder 119 for generates pulse signal corresponding to the movement speed of the conveyer.

The rotary encoder is not built-in the ink-jet printing device but installed in the conveyer, and the kinds of the rotary encoder varies many things such as an existing thing or prepared for newly by user.

A sensor 122 for detecting a printing object is often used photoelectric sensors, and commonly used type is outputting the signal during a printing thing shuts out the light.

Summery of the printing and the constitution of the ink circulation unit are explained next. An electrostrictive element of the nozzle make the ink pillar 110 ejected from the nozzle 109 into the ink particles 113 using the drive voltage generated by the drive voltage generation circuit 108. The electrostatic charge electrode 111 is given the voltage generated by the electrostatic charge voltage generating circuit 107, and the ink particles is charged by the voltage corresponding to letter signal. The charged ink particles 113 fly in the electric field formed by the inclination electrode 112 and are inclined according to the charged quantity and arrive at the printing object 115 which moves by conveyance conveyer 116 and forms letter. The ink particles not used for printing are collected by the ink collection gutter 114 and are supplied again to nozzle 109 by pump 117.

Figure 2:
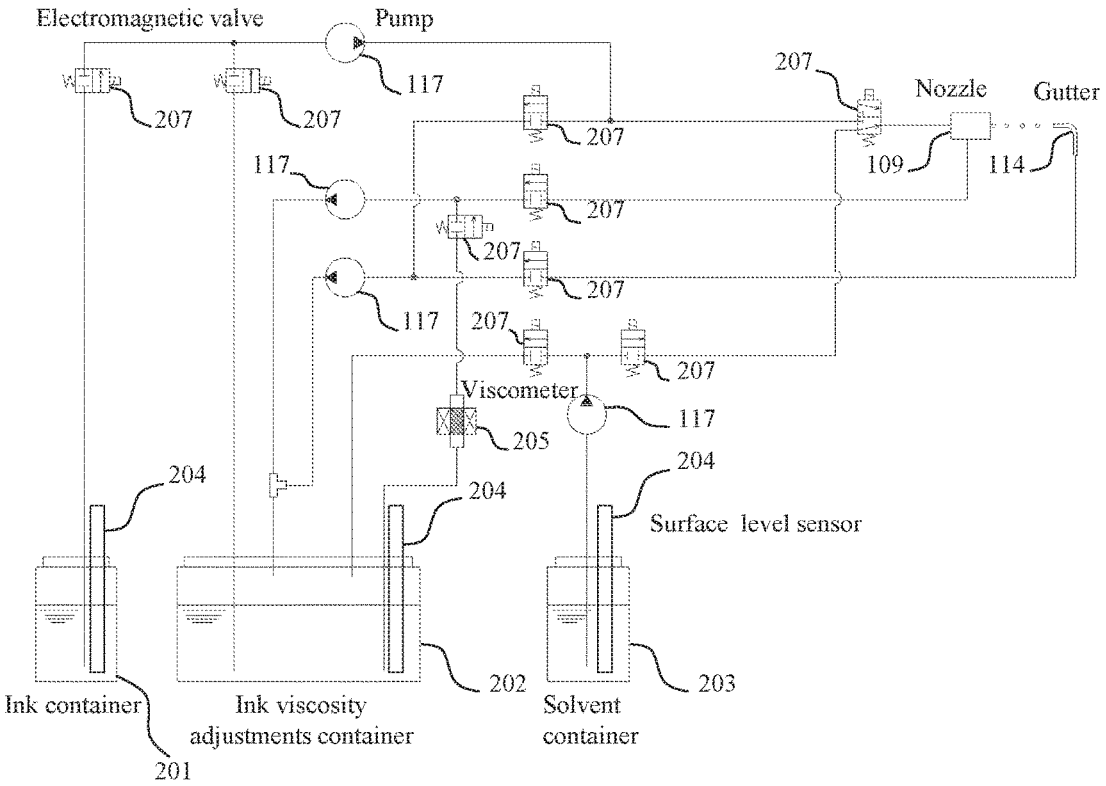
FIG. 2 the illustration of placements of the ink-jet printing device including the course of ink and solvent, the container and the sensor.

FIG. 2 is one of the examples of plumbing of the ink-jet printing device. The main components are, an ink container 201, an ink viscosity adjusting container 202, a solvent container 203, a surface level sensor 204 for detecting the surface level of these containers, a viscometer 205 for measuring the viscosity of ink, a pump 117 for delivering or aspirating ink and solvent, a solenoid valve 207 for sealing ink and solvent, a nozzle 109 for ejecting ink and solvent, a gutter 114 for collecting ink and solvent ejected from the nozzle.

There are many kinds of method for surface level sensor 204 to detect surface level of the liquid; a method by presence of the electrical conduction utilizing a single or plural stick-formed or board-formed sensors which vary in the length and having conductivity, a method by detecting up and down of a float floating on the liquid by a sensor, a method by detecting infrared rays by non-contact, a method by detecting change of the capacitance, and in addition, a method to calculating a surface by calculating the consumption by software.

In addition, these methods can be divided as the method that can detect a surface level with an intermittent point and the method that can detect a surface level into a detectable method continually.

There are two kinds of the container with these sensors; a type of container with a cap, and can be refill freely (referred to as "refillable type"), and a type of container with an exclusive connection, and is exchanged whole container (referred to as "cartridge type"). Furthermore, there are some kinds of the cartridge type; a type supplying ink and solvent directly from a ink cartridge referred as the ink container 201 and a solvent cartridge referred as the solvent container 203 as illustrated in FIG. 2, and a type temporary storing ink and solvent from the ink cartridge 208 and the solvent cartridge 209 to the assistance ink container 210 and the assistance solvent container 211 and supplying the needed amount of ink and solvent from the assistance containers for printing, viscosity adjusting and washing. In addition, both of the refillable type and the cartridge type can be constitution having and not having the ink viscosity adjustment container.

Figure 3:
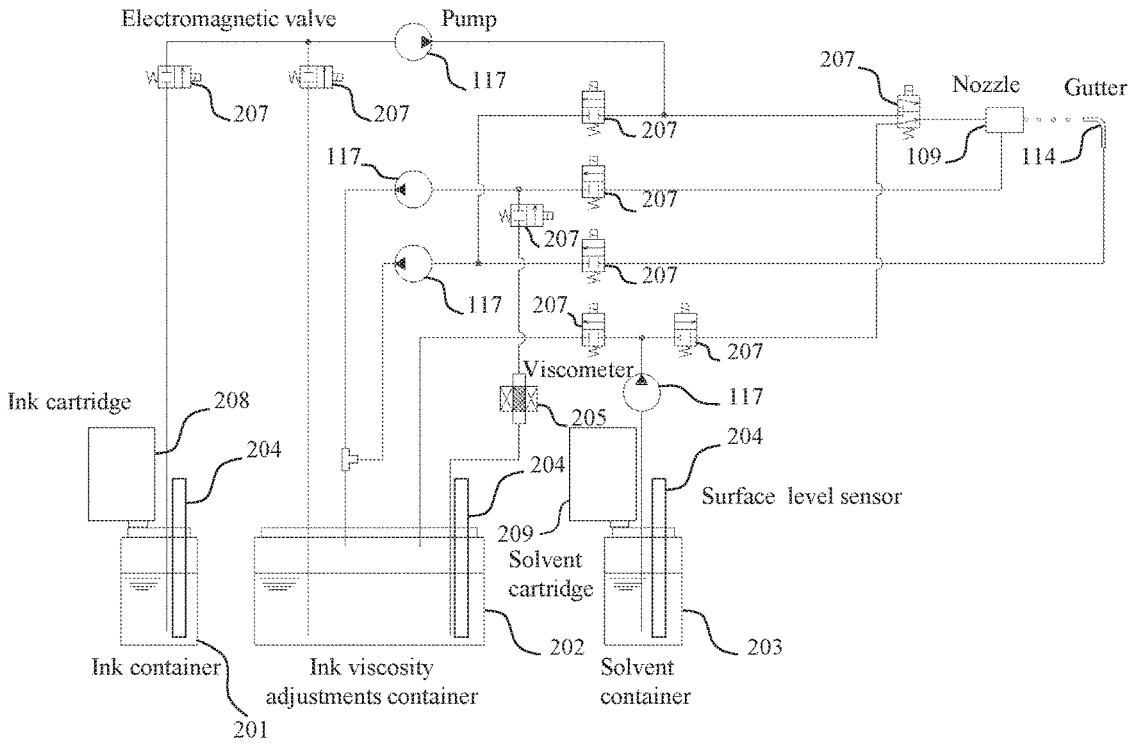
FIG. 3 the illustration of the cartridge type ink-jet printing device having the assistance container.

As described above, although the constitution for supplying ink and solvent varies, one of the leak detection methods in an ink-jet printing device comprising cartridge type containers 208 and 209 for containing ink and solvent each, assistance containers 210 and 211 containing ink and solvent each, and a sensor for continually detecting surface level of the assistance containers as is illustrated in FIG. 3, is explained below. Note that the structure of embodiments in this invention is not limited to the following concrete constitution, and is modifiable as far as the essence of the invention is not changed.

At first, surface change when leak does not occur is explained. When residual quantities of the assistance container 210 and 211 of ink and solvent are enough, the detected surface gradually falls down only with the quantity used with time by printing, viscosity adjusting, washing nozzle 109 which eject ink, evaporating from containers or other courses.

When the surface falls down by using the ink-jet printing device to a particular surface, a message or an icon indicating few residual quantities of ink and solvent, or a message or an icon promoting exchanging cartridge 208 and 209 is displayed, and then the user exchanges the cartridge 208 and 209. By cartridge exchange, the surface of residual quantity climbs into enough states in a short time. In the normal state without leak, the above-mentioned surface change will be repeated.

Surface change when leak occurs and a leak detecting method are explained next. When the leak occurred, lowering of the surface during use becomes earlier than that in the normal state, because consumption of the leakage is added to the normal state consumption. Leak can be detected by using this phenomenon.

The time of surface drop varies according to printing contents, kinds of ink, use environment, and usage, but can be estimated by calculation using theoretical consumption, and leak can be detected by comparing estimated time based on the theoretical consumption and the time really suffered. In addition, by storing past surface level change, leak can be detected by comparing with the real suffered time, and furthermore by using these two method together, the precision of leak detection improved.

Figure 4:
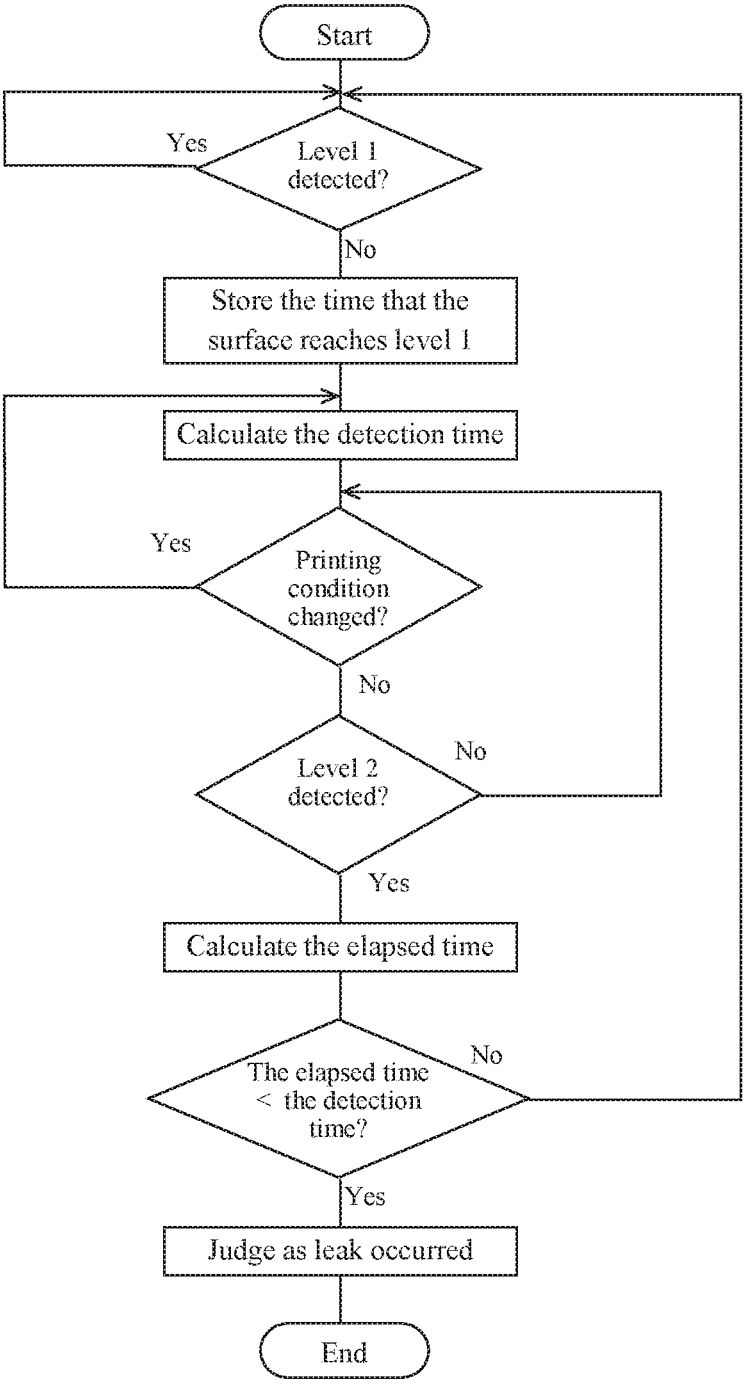
FIG. 4 the flow chart of the leak detection of embodiment 1.

FIG. 4 is a flow chart of leak detection method in this embodiment. In this flow chart, a start standard position of the initial surface level for detection processing is defined as level 1, and an end standard position of the surface level for detection processing after the surface level dropped by the ink and the solvent consumption is defined as level 2. At first, surface level detecting process is carried out repeatedly until the surface level drop to level 1, in other words, until the sensor cannot detect level 1 because of the surface which used to be over level 1 being under level 1.

Next, when a surface level reaches level 1, the time is stored in flash memory 102 or RAM 103. Then, the standard time for the detection namely the detection time are calculated based on the printing contents and the ambient temperature in the point in time.

Then, the change of printing contents and the ambient temperature are watched, and when the condition change that influences on the consumption of the ink and the solvent occurs, the detection time is recalculated each time. If the condition change doesn't occur, the surface level detection process is carried out in order to watch whether the surface level reaches level 2 (whether the surface level is less than level 2) that means the end standard position for the detection processing.

When a surface level reaches level 2, an actual elapsed time between the time the surface reached level 1 and the time the surface reached level 2 is calculated based on the detected and stored time that the surface reached level 1, that is the start standard position.

Finally the detection time is compared with the elapsed time and when the elapsed time is shorter, it is judged as the leak occurred and necessary processing such as message indication is carried out. When the elapsed time is the same with the determination time or within the predetermined allowable range, the level 1 detecting processing is started. Thereafter, in normal use, ink and solvent is refilled, and the processing following to the level 1 detecting processing are repeated.

Figure 5:
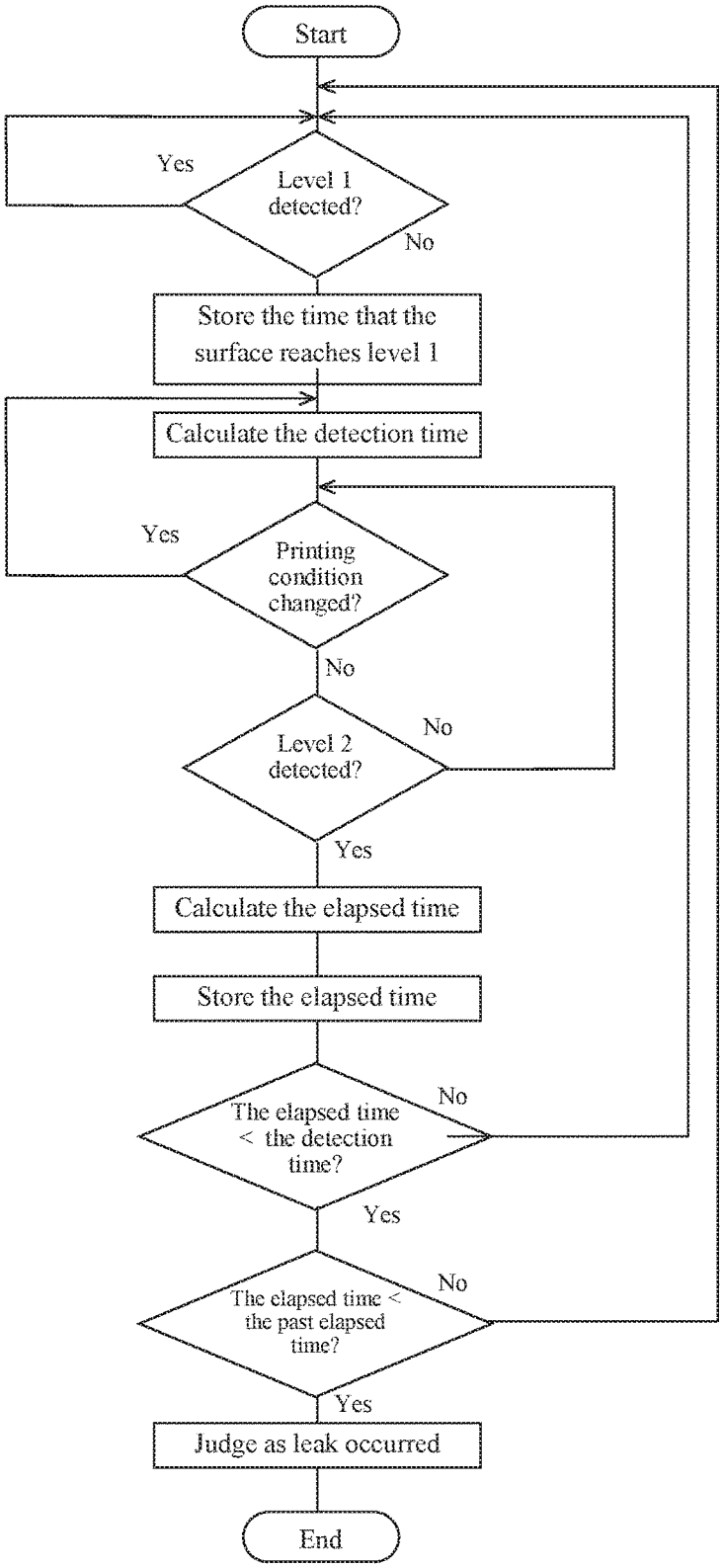
FIG. 5 the flow chart of the leak detection of embodiment 2.

FIG. 5 is a flow chart which is added the comparison processing with the real elapsed time in the past condition, to the flow chart in FIG. 4. In this flow chart, the elapsed time is calculated after detecting the surface reaching level 2, and the elapsed time is stored in flash memory 102 or RAM103 with the condition at the time.

Afterwards, the leak detection processing is improved by using both the detection based on the detection time calculated at the leak processing, and detection based on the stored past real elapsed time. As is explained, the influence of the differences from the calculated detection time, which is based on the variation of the individual ink-jet printing devices, an ink kind, use environment and term of use, can be minimized by storing the past real elapsed time.

The above mentioned embodiment can be applicable to the surface level detecting sensor of any method, if the sensor can detect surface level more than two points.

In this embodiment, the leak of ink and solvent in the assistance containers themselves and in the former course from the assistance containers can be detected because the leak is detected in the ink and solvent assistance containers, but in case of constitution having the cartridge and assistance containers, the leak can be detected by watching the change of the surface level of the assistance containers at the time of cartridge exchange.

In that case, the surface level of the assistance container continues to rise once and to decrease with use afterwards with each cartridge change. The leak can be detected in this detecting method, because if the leak occurs, it takes much time than regular state for the surface level to raise predetermined level, or the surface level start decreasing before rising predetermined level as the filling from the cartridge completes.

Figure 6:
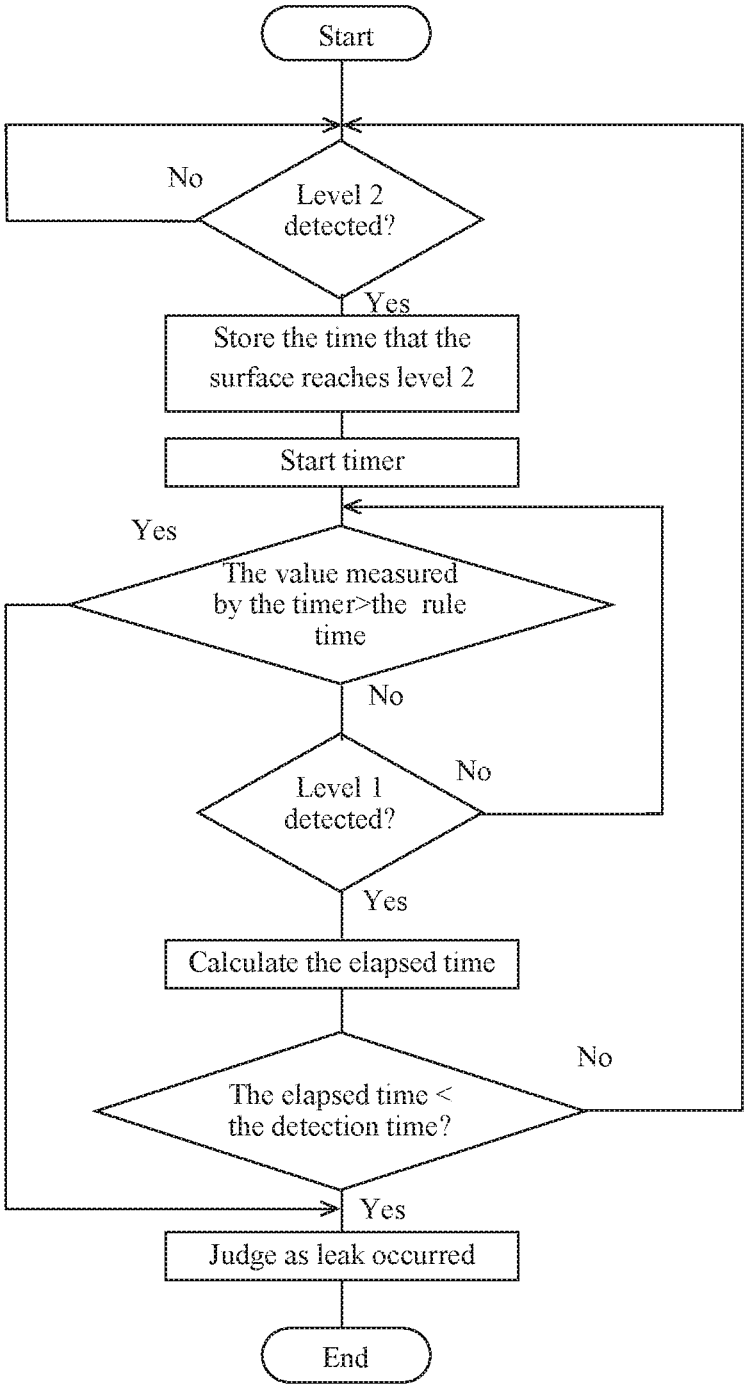
FIG. 6 the flow chart of the leak detection method using a surface level change at the time of the cartridge exchange.

FIG. 6 is a flow chart of a leak detection method using a surface level change at the time of the cartridge exchange. The surface level that the cartridge exchange can be done is defined as level 2, and the surface level higher than level 2 is defined as level 1. The surface detection processing is repeated until the surface level decrease and the surface level detected as level 2, because the surface level is in condition to be less than level 2 if cartridge exchange is possible.

Then, ink and solvent are supplied to the assistance containers from the cartridge when the cartridge is changed, the surface level rises, and the surface level is detected as level 2. That time is stored in flash memory 102 or RAM103. In addition, the timer stared at the time and the elapsed time is measured. In this case, the timer is used together as ink and solvent being supplied relatively in short period.

The surface detection processing is repeated until the surface level raise and the surface level detected as level 1. The elapsed time after the surface level detected as level 2 is calculated when the surface level detected as level 1 and compared with the detection time set beforehand.

When the elapsed time is longer than the judgment time, it is judged to occur the leak.

In addition, the value measured by the timer is compared with a rule time set beforehand and if the value exceeds the rule time, the processing stopped and judged as leak occurs, because the filling from the cartridge to the assistance container may complete before the surface level detected as level 1 when there is much quantity of leak.

In addition, according to this judging method, a problem in a joint of the cartridge and the assistance containers can be detected as abnormality other than the leak after the assistance containers.

Furthermore, the leak can be detected in a constitution of the containers except the above mentioned embodiment, e.g., a constitution with a cartridge and without assistance container, by watching the surface level (residual quantity) of ink and solvent, and by time to decreasing the surface, seeing the cartridge as the assistance container in the embodiment.

Furthermore, not in the cartridge type, but also in the refill type, the leak detection is possible by the judgment processing that is similar in the expression.

The leak detection method in the constitution that surface level detection more than two points is available is explained above, and the leak detection method when only one point of surface level detection is available is explained below.

The lead detection is available only in the cartridge type having assistance container, and not available in a type like the refill type in which any amount of ink and solvent can be refilled in any time, because in the case only one point of surface detection available, there is only information whether the surface level is detected or not, and similar judgment must be done based on that elapsed time, and that is affected by whether ink and solvent are refilled or not.

Figure 7:
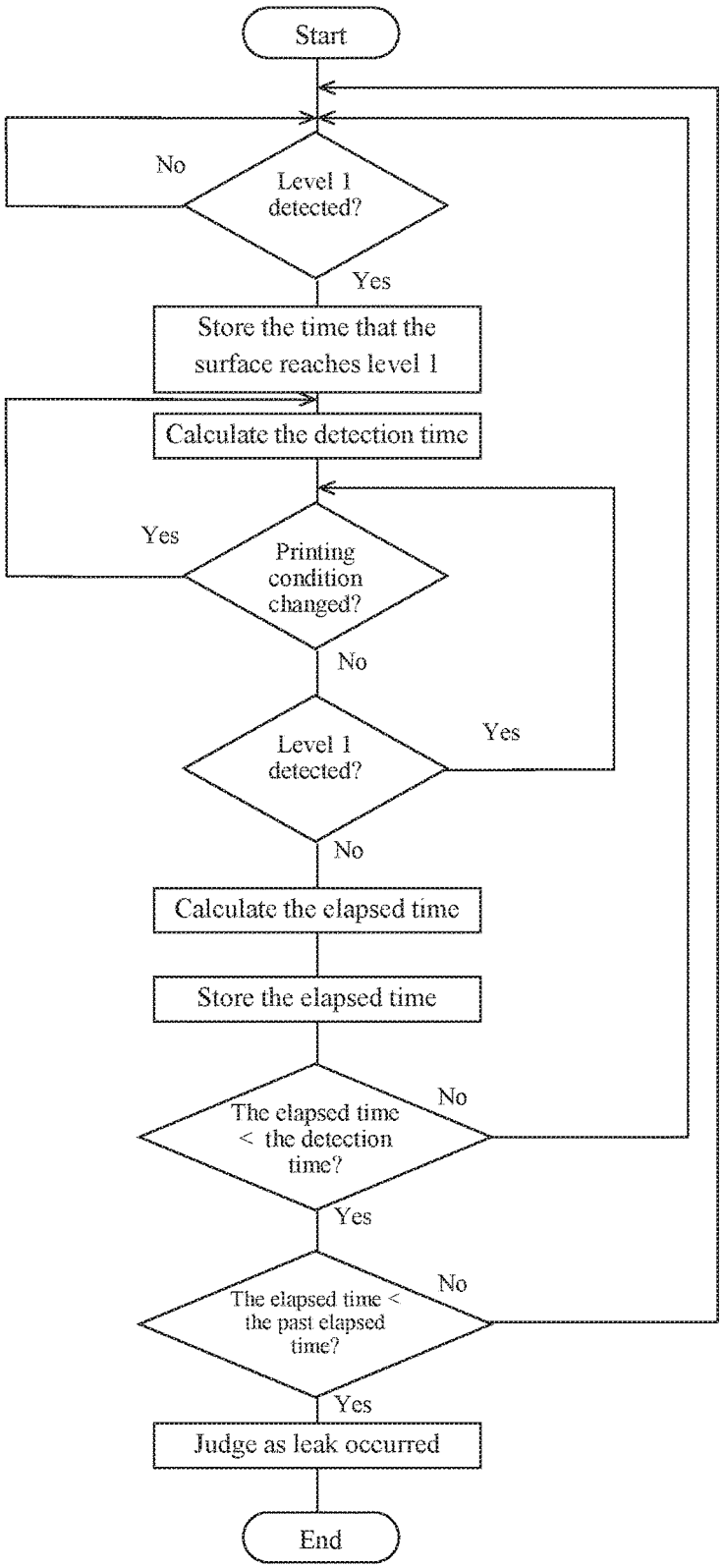
FIG. 7 the flow chart of the leak detection method in case of only one surface level detecting sensor being placed.

FIG. 7 is a flow chart of the concrete judgment processing. In this flow chart, a standard position of the surface level for the judgment processing is defined as level 1. This surface level 1 shows the surface level that is available for cartridge exchange, and cartridge exchange is only possible at the time of level 1 non-detection, and ink and solvent are only refilled by cartridge exchange.

In other words, that means the state of level 1 detection is only changed at the time of cartridge exchange. At first, in this condition, the surface level detection processing is repeated until the surface level reaches level 1 and it is detected, in order to wait the cartridge exchanged.

When a surface level reaches level 1 next, the time is stored in flash memory 102 or RAM103. And then, a standard time for detection namely the detection time is calculated based on the printing contents and ambient temperature in the point in time.

The printing contents and ambient temperature are watched and the detection time is recalculated in each time if condition change that affect to the consumption of ink and solvent are occurred. When there is not a condition change, whether the surface level is not detected as level 1, in other words, whether the decreased surface level is less than level or not, is judged next.

When the surface level becomes less than level 1, the gross quantity of ink and solvent supplied by the cartridge are considered to be used from the last time when the surface level is less than level 1, and the elapsed time from the time for gross quantity consumption is calculated and stored in memory.

Finally, the elapsed time and the detection time are compared, and if the elapsed time is shorter, the elapsed time and the past real elapsed time are compared next, and if the elapsed time is still shorter, it is judged as leak occurs and necessary processing such as message indication are carried out.

If the elapsed time is the same as the detection time or is within the tolerance level, the level 1 detection processing at the beginning of the flow chart is started. After this, ink and solvent is supplied in the normal use, and the level 1 detection processing and processing afterwards will be repeated.

The leak detection is possible by a similar method in the ink-jet printing device of the container constitution showed in the embodiments mentioned above or other container constitution, if the containers of the device comprise a surface level sensor. For example, the leak detection of the ink viscosity adjustment container only or with the leak detection of the ink container and the solvent container are available in the constitution showed in FIG. 2 and FIG. 3, since the ink viscosity adjustment container also comprises the surface level sensor.

The leak detection of the ink viscosity adjustments container and the course that is not directly connected to the ink container and the solvent container are available, if the leak detected by the surface level change of the ink viscosity adjustments container. In addition, earlier detection is enabled if the surface level change of the ink container and the solvent container takes time alone. Furthermore, more precise and rapid detection is available if both surface level changes of the ink and solvent container and the ink viscosity adjustment container are used together.

The ink-jet printing device which can detect leak of ink or solvent without using an exclusive leak sensor or without increasing cost, can be provided by utilizing the means mentioned above.

DESCRIPTION OF REFERENCE NUMERALS

101 MPU, 102 ROM, 103 RAM, 104 input panel, 105 display unit, 106 bas line, 107 charging voltage generating circuit, 108 excitation voltage generating circuit, 109 nozzle, 110 ink pillar, 111 electrostatic charge electrode, 112 inclination electrode, 113 ink particles, 114 ink collection gutter, 115 printing object, 116 conveyance conveyer, 117 pump, 119 rotary encoder, 122, 201 ink container, 202 ink viscosity adjustments container, 203 solvent container, 204 surface level sensor, 205 viscometer, 207 electromagnetic valve, 208 ink cartridge, 209 solvent cartridge, 210 ink assistance container, 211 solvent assistance container

What is claimed is:

1. An ink jet printing device for printing letters with ink, comprising:

a liquid container that holds an ink or a solvent;

a surface level sensor that detects surface levels of the ink or the solvent that is disposed in the liquid container;

a control unit; and a display unit, wherein the display unit displays a visual cue based on a comparison between: i) a measured time to transition from a first surface level of the ink or solvent in the liquid container to a second surface level of the ink or solvent in the liquid container, and ii) a previously calculated and stored time to transition from the first surface level to the second surface level, and a comparison between the measured time and a previously measured and stored time to transition from the first surface level to the second surface level.

2. The ink jet printing device according to claim 1, wherein the display unit displays the visual cue when the time to transition from the first surface level of the ink or solvent to the second surface level of the ink or solvent is larger than a normal time to transition under non leaking operation.

3. The ink jet printing device according to claim 2, wherein the normal time to transition is stored in a memory.

4. The ink jet printing device according to claim 3, wherein a first visual cue is displayed when the measured time is higher than the previously calculated and stored time, and a second visual cue is displayed when the measured time is lower than the previously calculated and stored time.

5. The ink jet printing device according to claim 1, wherein the surface level sensor is configured to detect more than two surface levels of the ink or the solvent.

6. The ink jet printing device according to claim 1, wherein the surface level sensor is configured to detect the surface levels of the ink or the solvent continuously.

7. An ink jet printing device for printing letters with ink, comprising:

a liquid container that stores ink or solvent, the liquid container being coupleable to a cartridge for supplying the ink or the solvent;

a surface level sensor that detects surface levels of the ink or the solvent that is stored in the liquid container;

a control unit; and a display unit, wherein the display unit displays a visual cue when a measured time to transition from a first surface level of the ink or solvent in the liquid container to a second surface level of the ink or solvent in the liquid container, upon the cartridge being attached to the liquid container, is different than a previously stored time to transition from the first surface level to the second surface level, the first surface level being lower than the second surface level.

8. The ink jet printing device according to claim 7, wherein the display unit displays the visual cue when the time to transition from the first surface level of the ink or solvent to the second surface level of the ink or solvent is larger than a normal time to transition under non leaking operation.

9. The ink jet printing device according to claim 8, wherein the normal time to transition is stored in a memory.

10. The ink jet printing device according to claim 7, wherein a first visual cue is displayed when the measured time is higher than the previously stored time, and a second visual cue is displayed when the measured time is lower than the previously stored time.

11. The ink jet printing device according to claim 7, wherein the surface level sensor is configured to detect more than two surface levels of the ink or the solvent.

12. The ink jet printing device according to claim 7, wherein the surface level sensor is configured to detect the surface levels of the ink or the solvent continuously.

* * * * *